US006570141B2

(12) United States Patent
Ross

(10) Patent No.: US 6,570,141 B2
(45) Date of Patent: May 27, 2003

(54) TRANSVERSE FLUX INDUCTION HEATING OF CONDUCTIVE STRIP

(76) Inventor: Nicholas V. Ross, 4137 Lockwood Blvd., Youngstown, OH (US) 44511

( * ) Notice: Subject to any disclaimer, the term of this patent is extended or adjusted under 35 U.S.C. 154(b) by 0 days.

(21) Appl. No.: 10/096,559

(22) Filed: Mar. 13, 2002

(65) Prior Publication Data

US 2002/0148830 A1 Oct. 17, 2002

Related U.S. Application Data

(60) Provisional application No. 60/278,795, filed on Mar. 26, 2001.

(51) Int. Cl.[7] ..... H05B 6/40; H05B 6/44

(52) U.S. Cl. ..... 219/645; 219/646; 219/672; 219/673; 219/676; 148/568; 266/129

(58) Field of Search ..... 219/645, 646, 219/635, 670, 673, 676, 636, 672, 675; 148/568, 567, 576; 266/129

(56) References Cited

U.S. PATENT DOCUMENTS

| | | | | |
|---|---|---|---|---|
| 2,479,341 A | * | 8/1949 | Gehr et al. | 219/646 |
| 3,031,555 A | | 4/1962 | Ross et al. | |
| 3,424,886 A | * | 1/1969 | Ross | 219/646 |
| 4,017,704 A | | 4/1977 | Collins, III et al. | |
| 4,357,512 A | | 11/1982 | Nishimoto et al. | |
| 4,678,883 A | | 7/1987 | Saitoh et al. | |
| 4,694,134 A | | 9/1987 | Ross | |
| 4,778,971 A | * | 10/1988 | Sakimoto et al. | 219/645 |
| 4,788,396 A | * | 11/1988 | Maugein et al. | 219/645 |
| 5,133,402 A | | 7/1992 | Ross | |
| 5,308,946 A | | 5/1994 | Mohr | |
| 5,495,094 A | | 2/1996 | Rowan et al. | |
| 5,767,490 A | * | 6/1998 | Peter | 219/645 |
| 5,770,838 A | | 6/1998 | Rohrbaugh et al. | |
| 5,799,720 A | | 9/1998 | Ross et al. | |
| 5,895,599 A | | 4/1999 | Nivoche | |

FOREIGN PATENT DOCUMENTS

| | | | |
|---|---|---|---|
| JP | 63-279592 | * 11/1988 | 219/645 |

OTHER PUBLICATIONS

Nicholas V. Ross, Gerald J. Jackson, Induction heating of strip: Solenoidal and transverse flux, Iron & Steel Engineer, Sep. 1991.

* cited by examiner

*Primary Examiner*—Philip H. Leung
(74) *Attorney, Agent, or Firm*—Jones, Tullar & Cooper, P.C.

(57) ABSTRACT

In transverse flux induction heating of electrically conductive strip, conductors that cross the strip width are stacked, or connected, such that a multiple of the induced current flows across the strip width as compared to that which flows along the strip edges. Conductors across the width of the strip and conductors along the edges of the strip are connected in series to insure that the current which flows in the conductors is everywhere the same. In the case of two stacked cross conductors, this gives an $I^2R$ heating of four times the heating across the strip width as compared to that along the strip edges.

19 Claims, 20 Drawing Sheets

TRANSVERSE FLUX INDUCTION HEATING OF CONDUCTIVE STRIP

CROSS-REFERENCE TO RELATED APPLICATION

The benefit of provisional application No. 60/278,795 filed Mar. 26, 2001 is claimed. Provisional application No. 60/278,795 filed Mar. 26, 2001 is incorporated here by reference.

TECHNICAL FIELD

This invention relates to heating electrically conductive material, such as metal strip, by transverse flux induction, or "TFI". By way of example, such heating can be for the purpose of affecting the metal itself or for the purpose of affecting coatings on the metal.

BACKGROUND ART

Background information on TFI is presented in the article "Induction heating of strip: Solenoidal and transverse flux" by Nicholas V. Ross and Gerald J. Jackson, *IRON & STEEL ENGINEER,* September 1991.

TFI heating of metal strip can over-heat the edges of the strip, when the inductor coil is wider than the strip. This can occur due to electromagnetic phenomena at the discontinuity in electrical conduction formed at an edge. See FIG. 6 of the article referenced in the previous paragraph. At metal locations removed from the edge, electrical current density may be low, while, at the edge, the same current can be forced into a very limited region, thereby greatly increasing current density, leading to over-heating and, particularly in the case of aluminum, even to edge melting.

DISCLOSURE OF INVENTION

It is an object of the invention to provide new methods and installations of TFI characterized by the ability to deliver significantly reduced amounts of electrical current and current density to edge regions of electrically conductive material, such as metal strip, compared to that delivered across the width of the material.

The invention provides a number of improvements in the arrangement of the coils of the inductors for TFI heating of electrically conductive material, such as metal strip, or graphite cloth. For instance, coil conductors that cross the strip width are stacked, or connected, such that a multiple of the induced current flows across the strip width as compared to that which flows along the strip edges. Alternatively, or additionally, by shaping the conductors to a wedge, or other concentrating shape, we can induce currents in the strip within a narrow width, in order to increase the current density across the strip width compared to that which flows along the strip edge. Alternatively or additionally, the coils have variable dimensions, in order to adjust the inductive heating effect.

Preferably, the coil conductors across the strip width and the coil conductors along the strip edges are connected in series to insure that the current which flows in the conductors is everywhere the same. In the case of two stacked cross conductors, this gives an $I^2R$ heating essentially four times the heating across the strip width as compared to that along the strip edges, since heat is proportional to current squared.

In preferred embodiments of the invention, the induced current across the strip is essentially an integral multiple of that along the strip edges, with a preferred integer being two. The qualification "essentially" is used, because, in practice, some departure from integral multiple may be experienced, for instance because one conductor in a vertical stack of conductors will be farther from the strip than the other, or because one leg of a split-return inductor may carry slightly more current than the other. As implied, the qualification "vertical" is for the case of a strip in the horizontal plane; more generally, the departure will be for the case where the stacking is perpendicular to the plane of the strip.

The term "strip" is used generically herein and intended to cover elongated material in general, such as sheet, strip, plate, and cloth. Preferred, however, is material whose thickness is within the depth of current penetration d as defined in the article cited above in the BACKGROUND ART.

BRIEF DESCRIPTION OF THE DRAWINGS

In the drawings, I is used to indicate inductor current and i for induced current.

MODES OF THE INVENTION

Figure 1A:
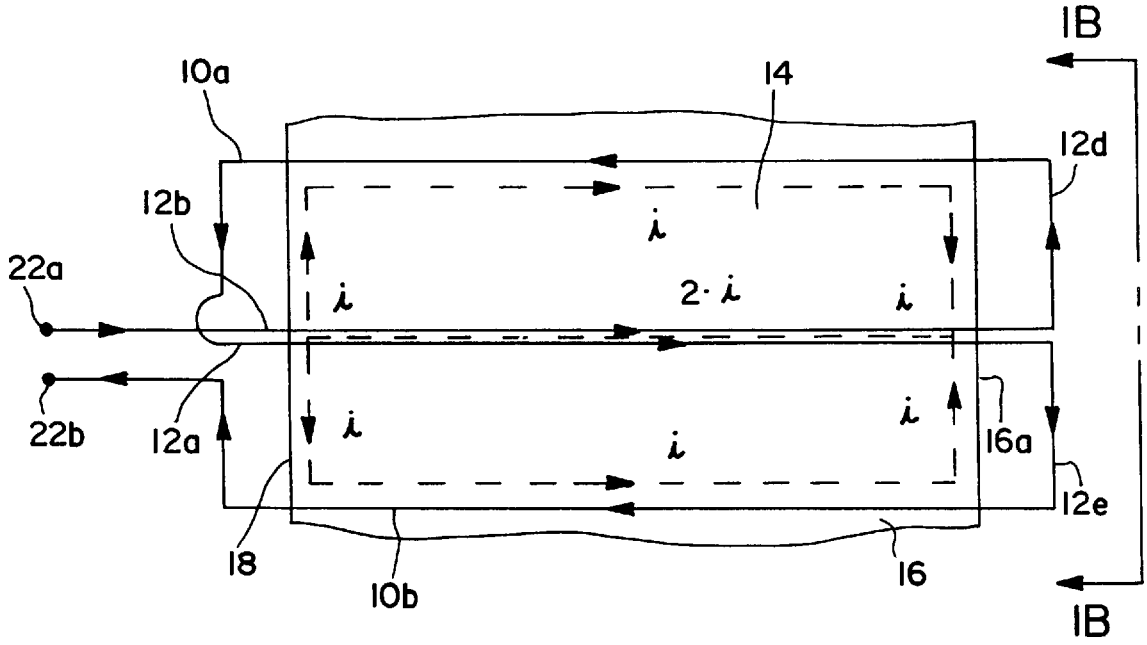
FIG. 1A is a schematic, top view of two inductor coils arranged above, and two below, a metallic strip.

Turning now in detail to the drawings, wherein like numerals denote like components, FIG. 1A shows two rectangular coil inductors 10*a*,10*b* nested and connected above a metal strip 16 to form a unit in such a manner that the same current flows in all legs (conductors) of the inductor coils. Two other inductor coils below strip 16 are hidden beneath inductors 10*a*,10*b* in FIG. 1A. The current in the conductors is indicated by arrows on the conductors and the induced current by arrows on the dashed loops drawn on the strip 16 within the inductor coils. Because the two coils are connected in series, the current is the same in all conductors of the coils.

By "overlapping" or vertically stacking the two center conductor legs 12*a*,12*b* of the coils, the induced current i, and the current density, across the width 14 of strip 16 is twice as great as that which flows along the strip edges 18, for example, due to the legs 12*d* and 12*e* diverging from one another to extend along the edge 16*a* of the strip. Since heating obeys an $I^2R$ law, the relative heating along the edges is one-fourth of that across the strip width.

Because, as noted in the above section BACKGROUND ART, current density increases at the strip edges when the inductors, as here, extend beyond the strip edges, temperature distribution in metal strip is much more uniform when using the vertically stacked "TFI" inductors of the present invention.

Figure 1B:
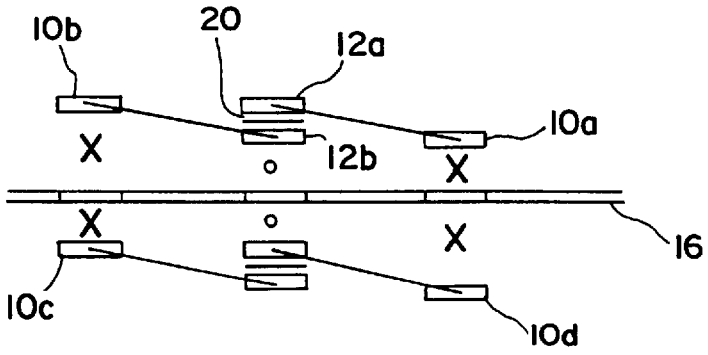
FIG. 1B is a schematic view of the coils and strip of FIG. 1A taken from the viewing planes 1B—1B of FIG. 1A

FIG. 1B shows the vertical stacking of the conductors 12*a* and *b*, which are, however, prevented from contacting one another by electrical insulation 20. FIG. 1B also shows the presence of two additional, matching inductors 10*c* and *d* below the strip. The presence of the additional inductors 10*c* and *d* enables greater heat input to the strip and, consequently, the strip can move at a higher line speed, to increase production rate. The dot (.) and cross (x) symbols in FIG. 1B, and in other figures discussed below, show the directions of the current in the conductors, the dot indicating movement toward the viewer, and, the cross, movement away. As will be noticed from the drawing, aspect ratios, width/height, greater than 1 are preferred for the conductor cross sections, because the stacked conductors are then closer together; naturally, this cannot be carried to extreme, because then the spreading of the conductors lowers induced current density below the stacked conductors. While conductors 12*a* and *b* are vertically stacked in this instance of a horizontal strip, a move general concept of the invention is that the conductors are stacked perpendicularly to the plane of the strip.

It is understood that more than a 2:1 current, and current density, ratio can be established by stacking more than two conductors.

In FIG. 1A, it is understood by Kirchhoff's Law of current flow being equal through a given circuit, if connected in a series manner, that, regardless of any irregularity in the series circuit as to length or cross section, the magnitude of the current is always the same. The induced current density J is not necessarily the same, as it depends upon the cross-sectional area of the conducting path. By stacking vertically two conductors connected in series we double the current density in the strip, J=2i/W, and thereby increase the resulting heating by a factor of 4 (four).

Figure 1C:
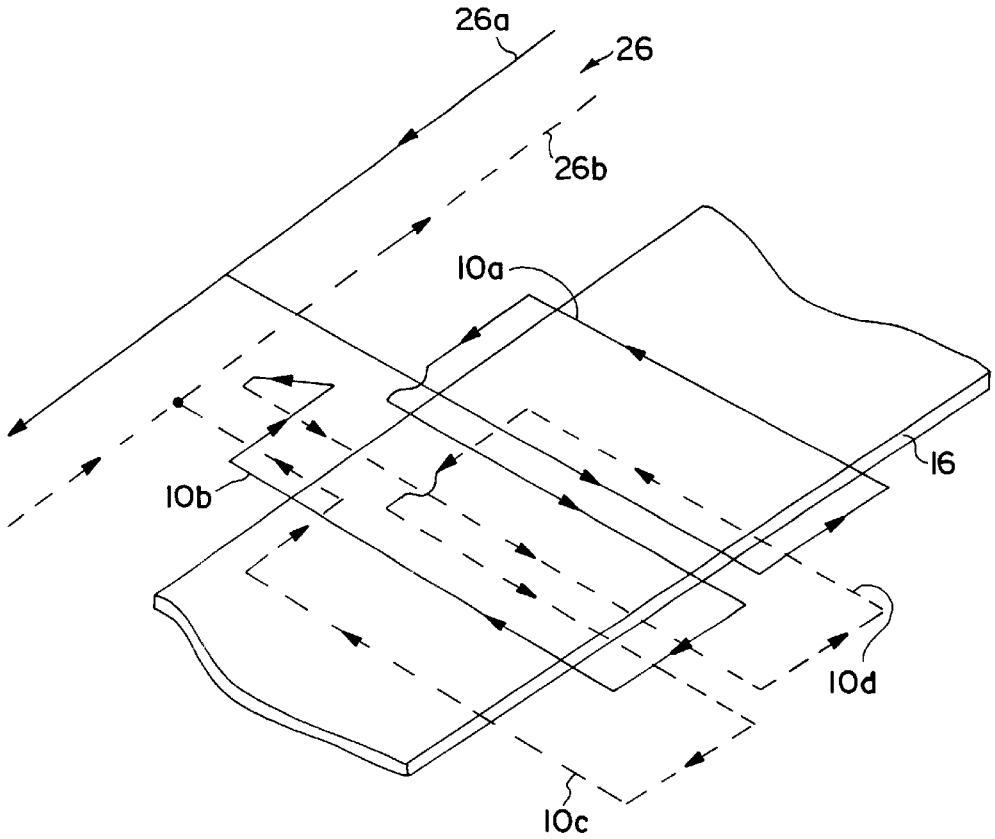
FIG. 1C is a schematic, perspective view of the arrangement of FIG. 1B.

FIG. 1C shows that the inductor units 10*a,b* and 10*c,d* on opposite sides of the strip 16 are connected in series between the bus bars 26*a,b* of main bus 26, so that the inductor current above and below the strip is also the same. The inductor unit 10*a,b* above the strip is drawn with solid lines and that below, unit 10*c,d,* with dashed lines.

Figure 2:
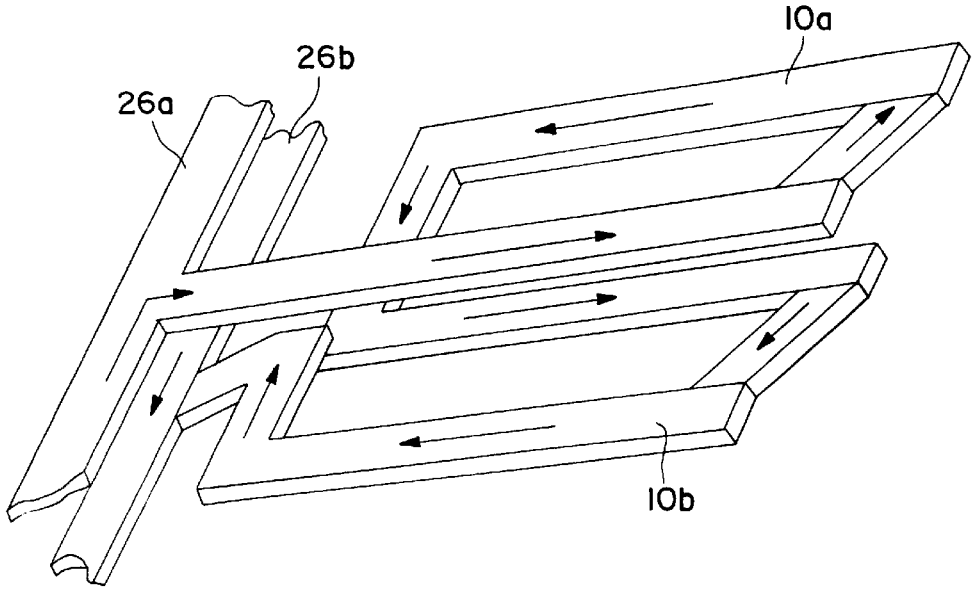
FIG. 2 is a perspective view of an embodiment of the top two coils of FIG. 1A.
Figure 3:
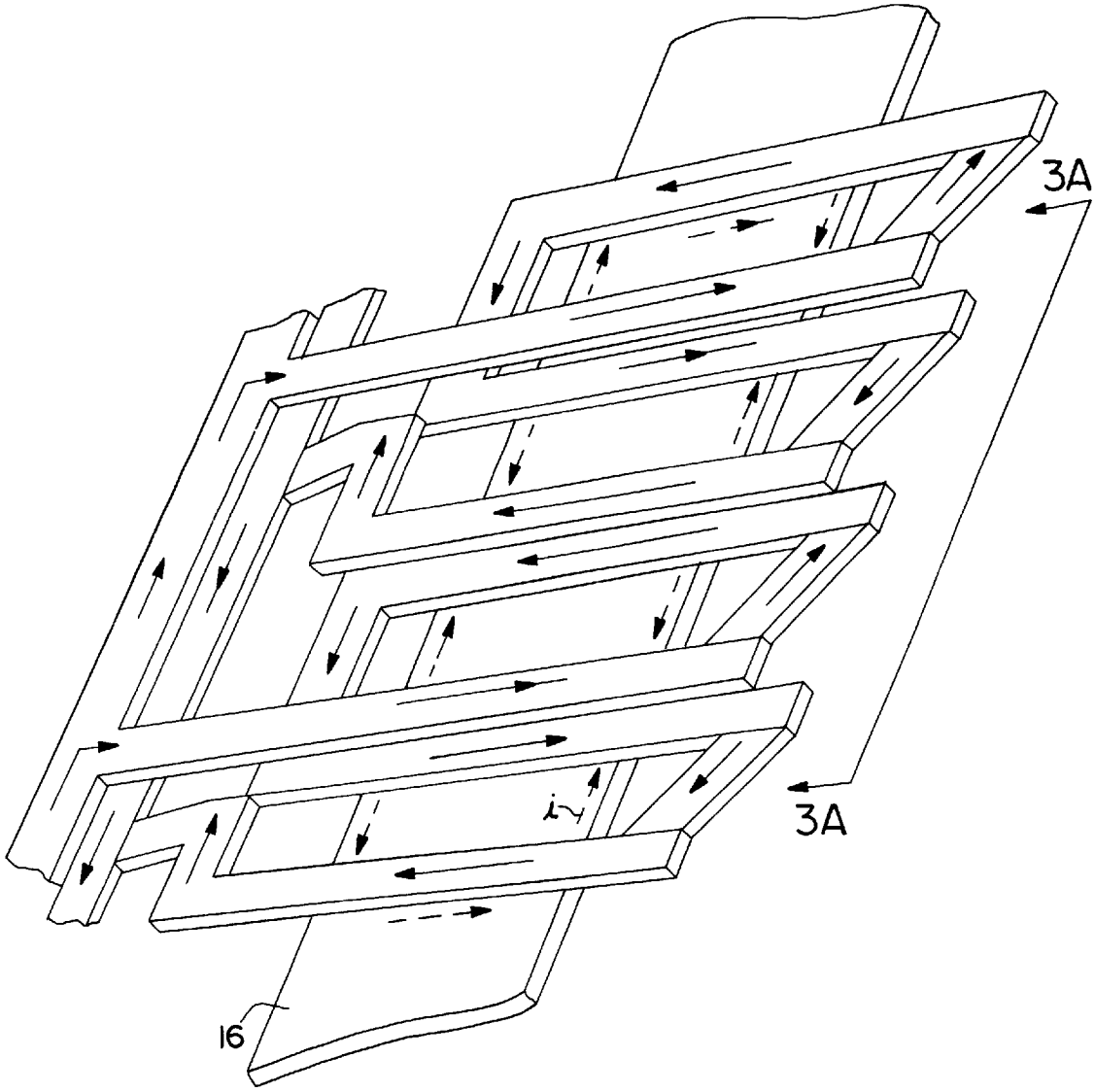
FIG. 3 is a view as in FIG. 2 showing multiple coils above a strip.

FIG. 2 details the nesting of an inductor unit constructed similarly to the top unit of FIG. 1A, to provide two nested, overlapping coils 10*a*, 10*b*. FIG. 3 shows two units of the kind shown in FIG. 2, nested together above a strip 16, while FIG. 3A provides a corresponding end view.

Figure 4A:
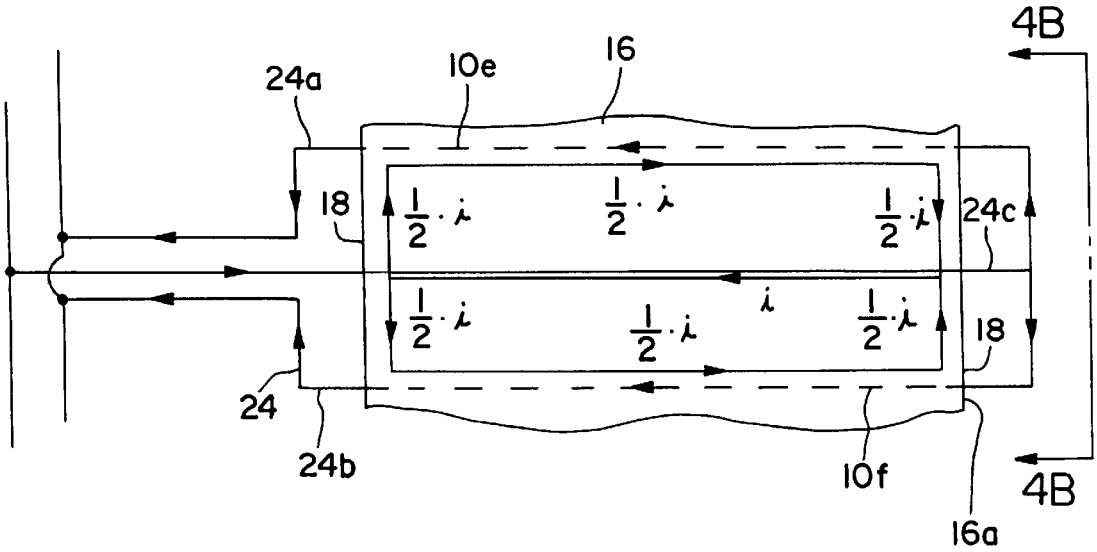
FIG. 4A is a schematic, top view of a split return inductor straddling a metallic strip.
Figure 4B:
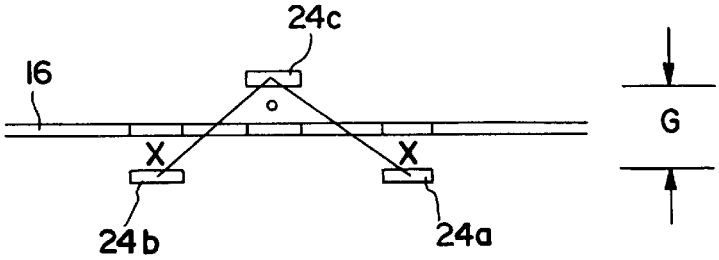
FIG. 4B is a schematic view of the inductor and strip of FIG. 4A taken from the viewing plane 4B—4B of FIG. 4A.

FIGS. 4A,4B show another embodiment of the invention to insure a 2:1 current ratio. In this case, the current ratio results from the way in which the conductors are connected, rather than by a stacking of conductors. Thus, in this instance, a bilateral split-return inductor 24 is used. It is bilateral in that it straddles the strip, with the return legs 24*a,b,* underneath, or on the opposite side of, the strip as that of the center leg 24*c*, diverging from one another to extend along strip edge 16*a* and back across the strip. While a current i is induced in the strip beneath the center leg extending across the strip, only ½i is induced along the strip edges 18 and back beneath the return legs. As viewed from above, as in FIG. 4A, this embodiment still has two coils 10*e*, 10*f*, same as for the top of FIG. 1A. Return legs 24*a,b* are dashed in FIG. 4A, to indicate that thay are below strip 16.

By placing the return legs and center leg on opposite sides, the air gap G (FIG. 3B) remains the same with respect to the strip regardless where the strip is. The vertical spacing G, or gap between the return legs and the center leg, does not change with the position of the strip. The significance of the gap G remaining constant is that the inductive heating of the strip does not change with vertical position of the strip in the gap, i.e. reactance does not change with strip position within the gap.

Figure 3A:
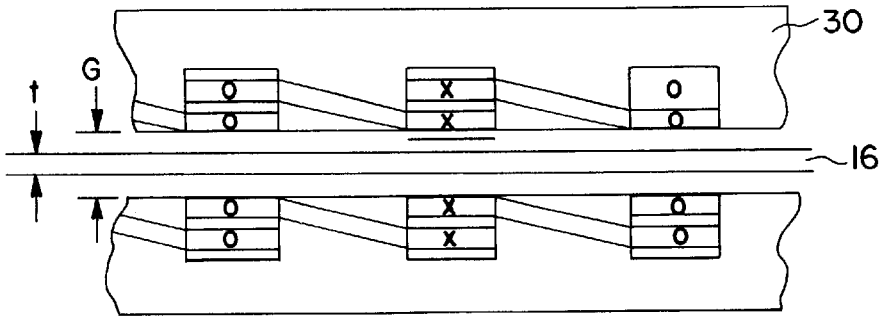
FIG. 3A is a schematic, view of coils and strip taken from the viewing plane 3A—3A of FIG. 3, additionally including coils below the strip.
Figure 4C:
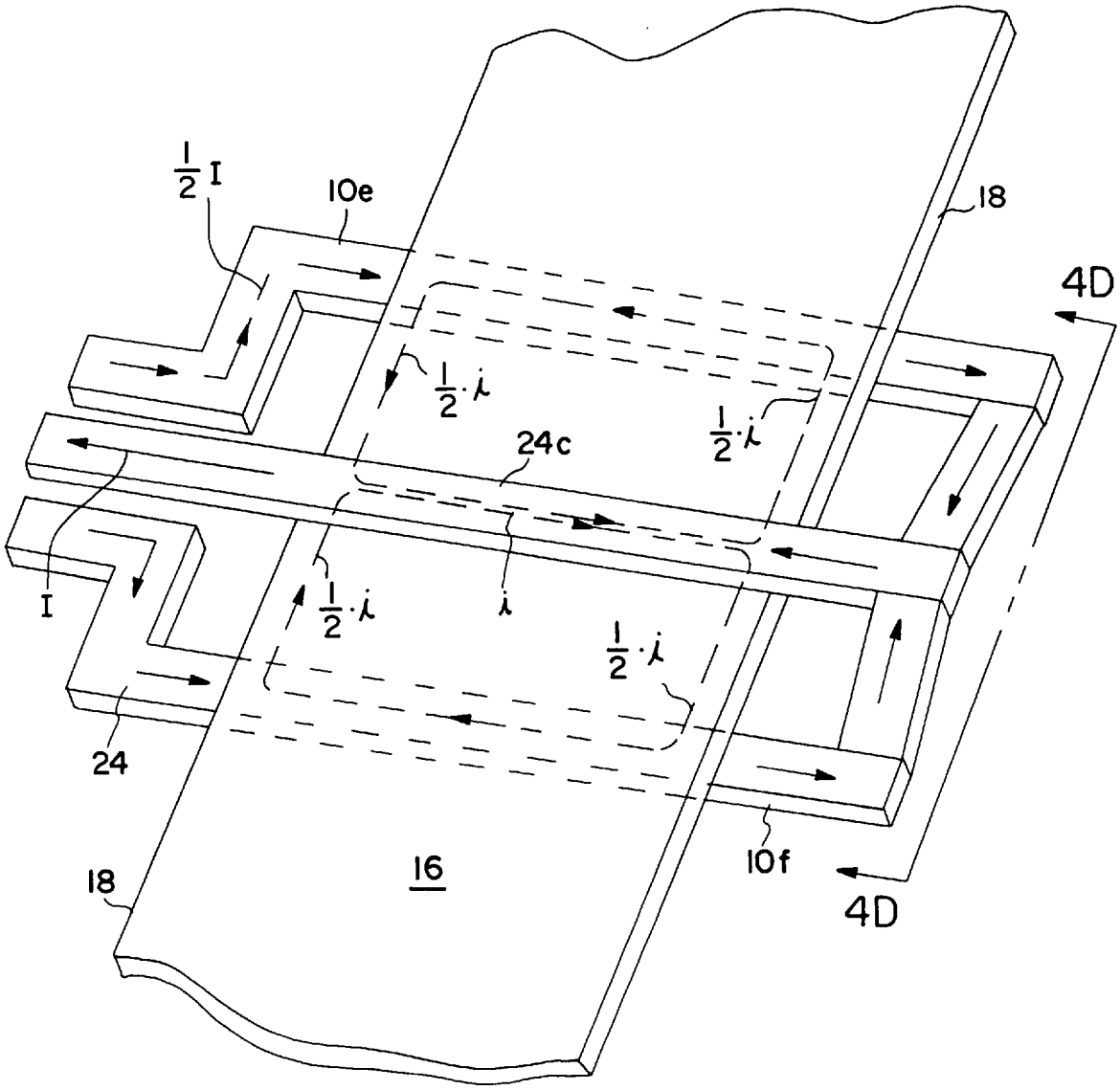
FIG. 4C is a perspective view of an embodiment as in FIG. 4A, except that current flow is reversed.
Figure 4D:
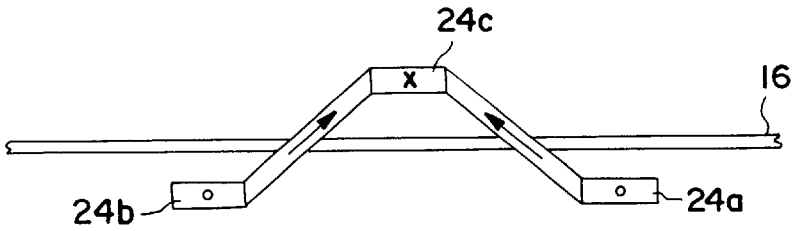
FIG. 4D is a view taken from the viewing plane 4D—4D of FIG. 4C.

FIGS. 4C and 4D illustrate in perspective view an embodiment as in FIG. 3A, except that inductor current I is reversed, a difference of no significance to the heating effect achieved by induced currents in the strip. Split-return inductor 24 straddles strip 16, with the return legs 24*a,b,* underneath, or on the opposite side of, the strip as that of the center leg 24*c*. While a current i is induced in the strip beneath the center leg, only ½i flows along the strip edges 18 and back opposite the return legs.

Figure 5A:
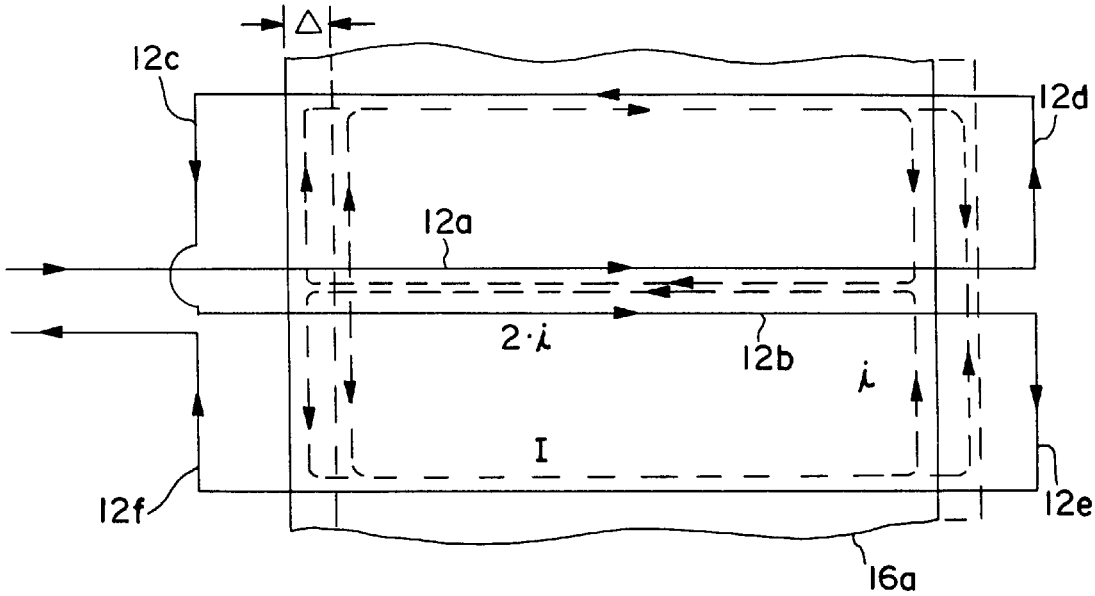
FIGS. 5A–5C are schematic, top views showing the same inductor coils of FIG. 1A associated with metal strip of different widths.
Figure 5B:
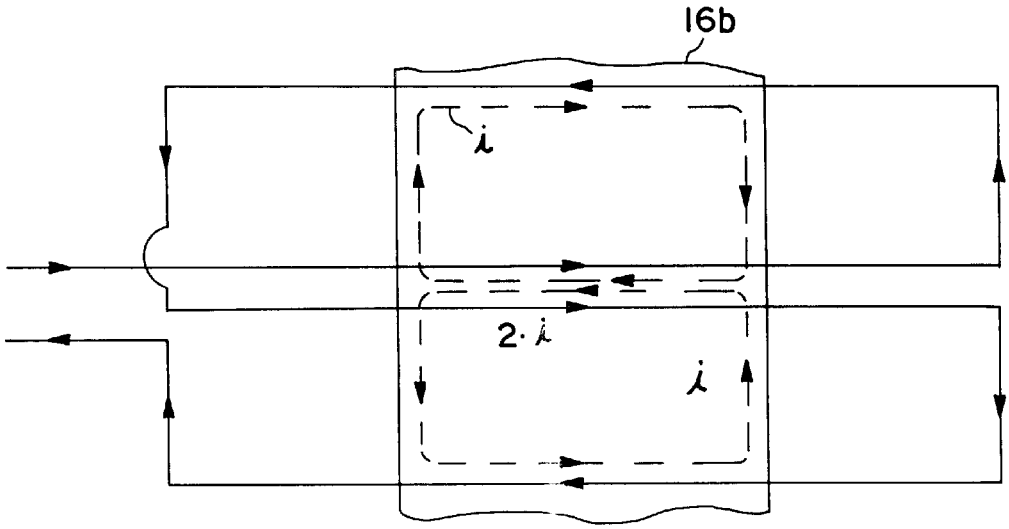
Figure 5C:
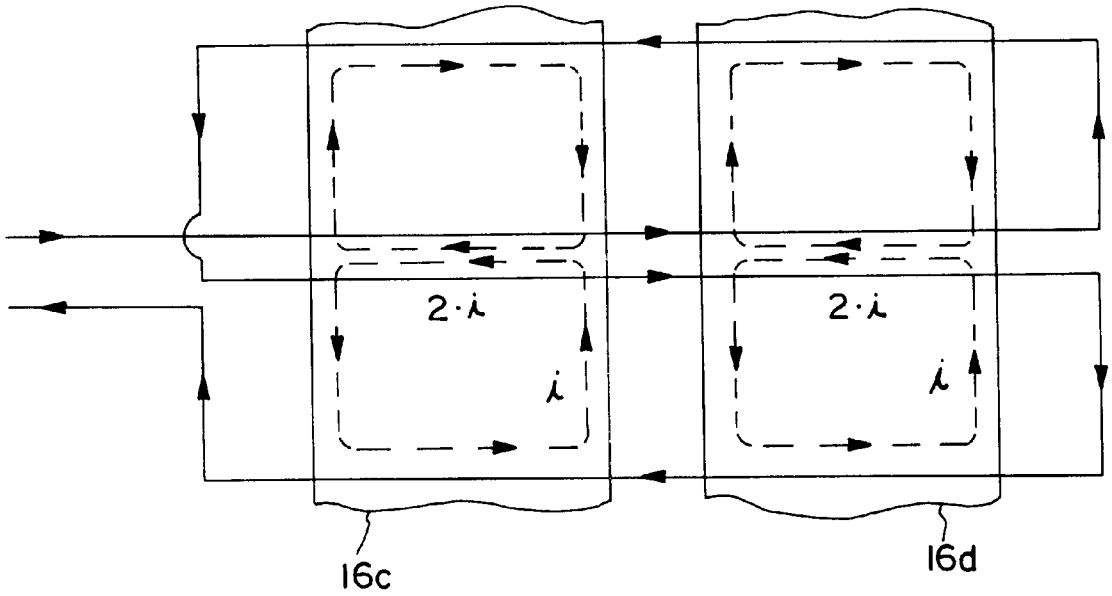

FIGS. 5A–C show an inductor unit similar to that of FIG. 1A, associated with strips of different width.

In FIG. 5A, a wide strip 16*a*, of width that is still contained within the window of the outer legs 12*c,d,e,f* of the inductor, will induce the 2:1 ratio of current density across the strip width as compared to that along the strip edges. The strip may move laterally, as it will in the real world, but, as long as it is contained within the outer legs of the inductor, the 2:1 current density ratio is maintained. An example of a lateral movement A (delta) within the outer legs is shown in FIG. 5A.

In FIG. 5B, for a strip 16*b* narrower than that of FIG. 8A, the ratio of 2:1 is kept, so the ratio of 4:1 heating is kept as well.

Next, FIG. 5C illustrates that we can charge several strips, e.g. strips 16*c,d* of equal but narrower width and heat them just as uniformly as the single strips.

A major advantage of this invention is that we do not have to adjust the window of the inductor in any way to accomplish the heating of wide, narrow or multiple strip.

We can very easily adjust voltage, power, frequency or strip speed to accommodate various temperature levels, production rates or variation of strip materials, i.e. stainless steel, carbon steel, aluminum, brass, copper, graphite cloth, etc., as well as strip thickness t (gauge).

Figure 6:
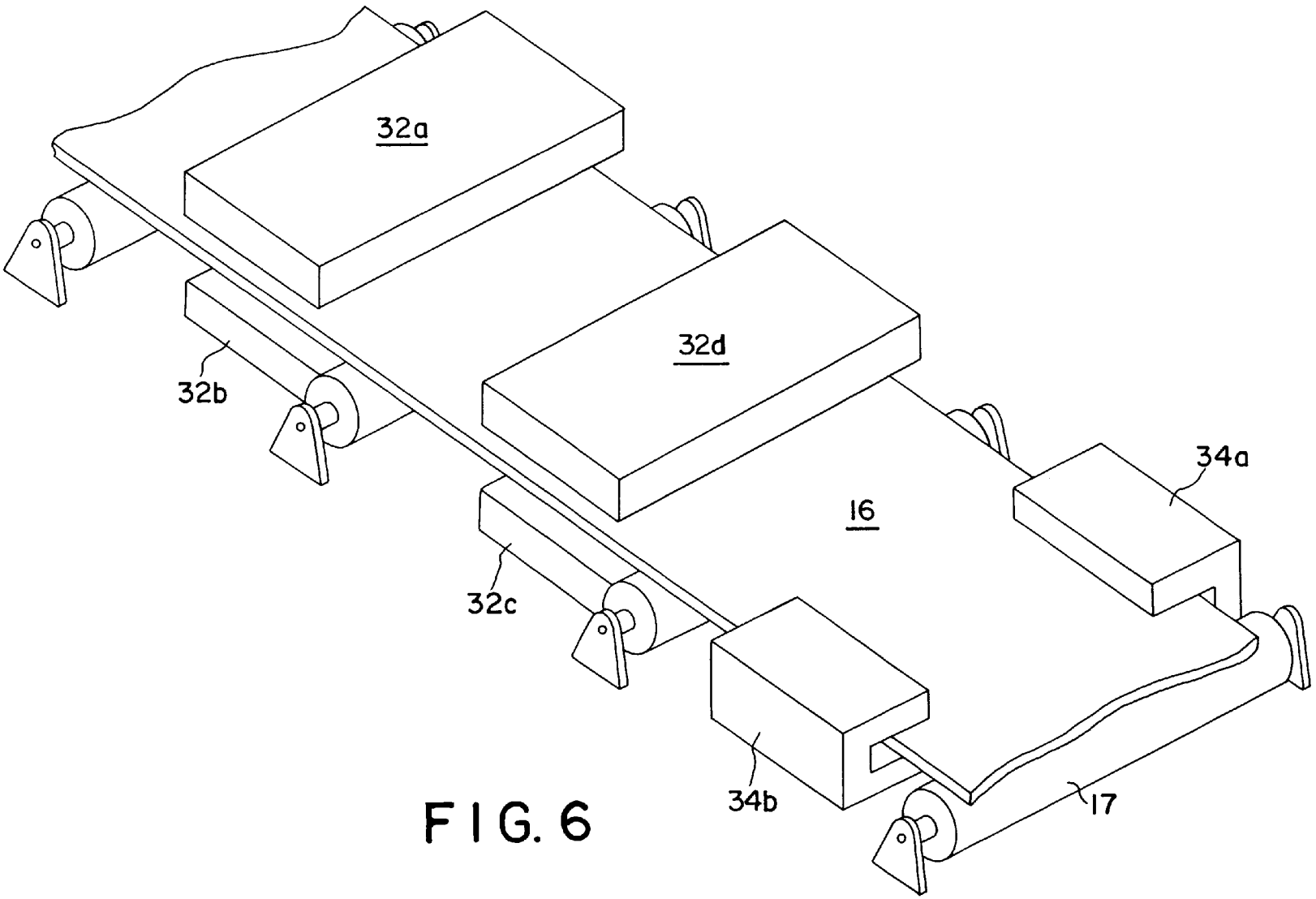
FIG. 6 is a perspective view of several inductors arranged as part of a strip conveyor conveying strip during heating

FIG. 6 illustrates a production line for heating strip 16 conveyed on rollers 17 with several nested, 2:1 current ratio inductors 32*a,b,c,d,* plus additional edge heating inductors 34*a,b,* should the edges be too cold under some conditions, or greater heat is wanted on the edges.

Figure 6A:
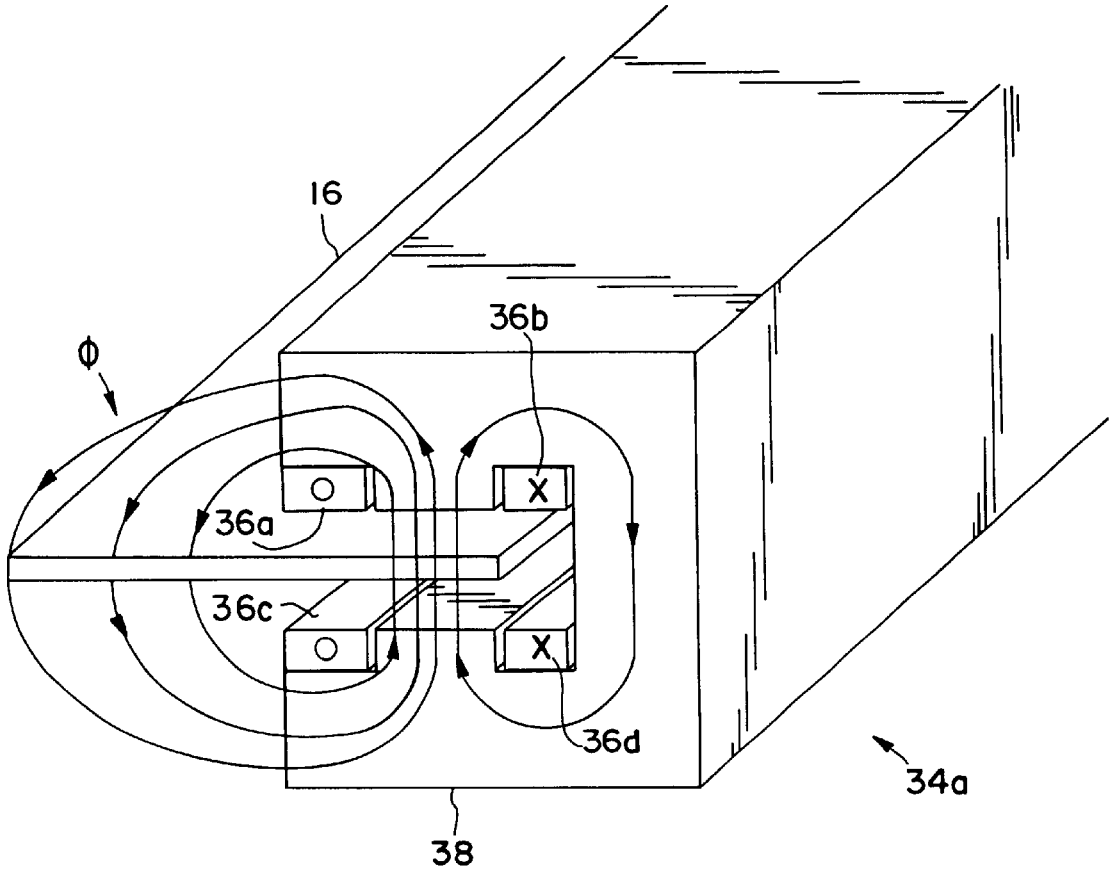
FIG. 6A is a detail of a component of FIG. 6 for edge heating of the strip, if necessary.

FIG. 6A details edge heater 34*a*, showing conductors 36*a,b,c,d,* which cause magnetic flux $\phi$, and laminated core 38 to concentrate the magnetic flux. Heating is by TFI electrical induction.

Figure 7:
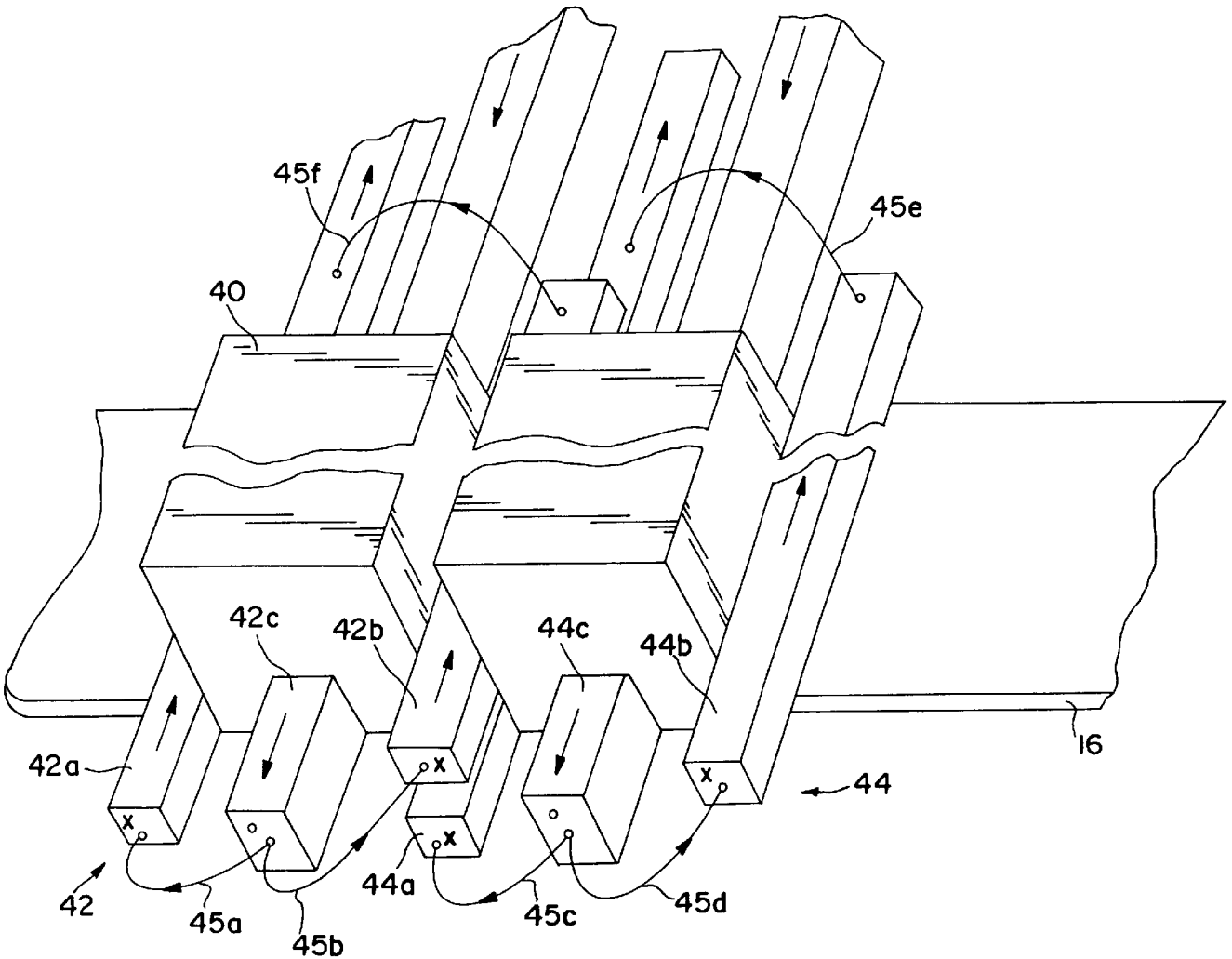
FIG. 7 is a perspective view of an embodiment of the invention, showing the electrical connections of two inductor units.

FIG. 7 shows an embodiment based on split-return inductors. However, unlike the embodiment of FIG. 3A, the inductors here do not straddle the metal strip 16. These are, therefore, unilateral split-return inductors. In this case, more attention must be paid to the electromagnetic characteristics of the return legs, i.e. to their reactance, in order to assure, as much as possible, that the electrical current from the center leg gets divided equally into each of the return legs. This is essentially an engineering problem, but its presence makes these embodiments less preferred in that respect.

Referring now to the details of FIG. 7, this embodiment shows a nesting of two split-return inductor units 42 and 44 above strip 16. As in the other embodiments described above, the conductor legs are embedded in magnetic flux concentrating cores 40 composed of thin, silicon steel laminations. Inductor unit 42 is composed of return legs 42*a,b* and center leg 42*c*. Its nested neighbor 44 to the right has return legs 44*a,b* and center leg 44*c*. Also shown are the electrical connections 45*a-f* for conducting the current between the legs.

When stacking conductors in the direction perpendicular to the plane of the strip, we must strive to eliminate counter induced currents in inner conductors caused by currint in outer conductors. Thus, the effect of increased current density induced in the width of the strip can be reduced, if outer legs in a stack induce counter electrical currents in inner legs. FIGS. 8–10 and 10A illustrate ways to reduce such induced current.

Figure 8:
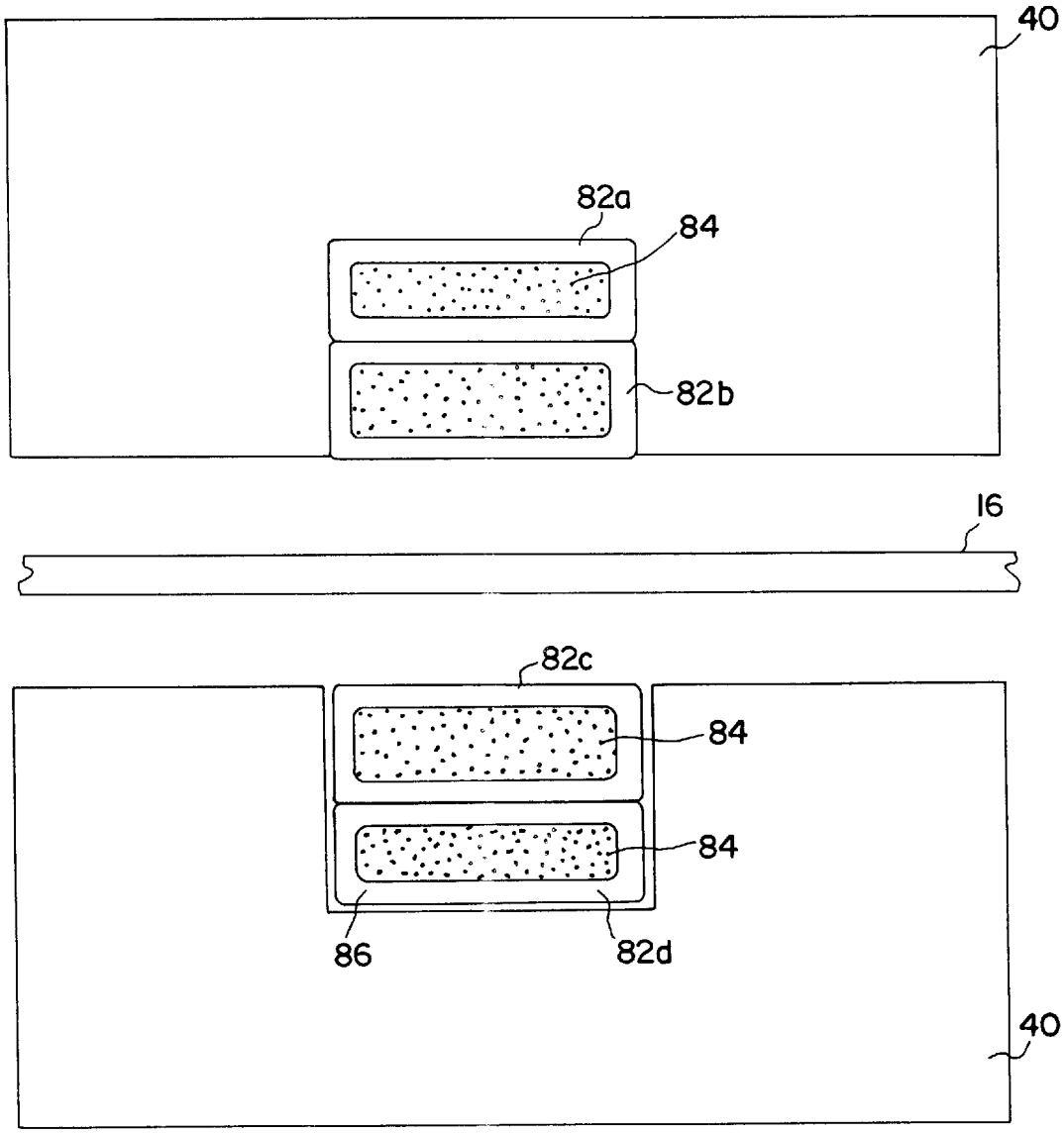
FIG. 8 is an elevational view of four conductor legs, one from each of four inductors (remainder of the inductors not shown), stacked two above and two below a metal strip, with each set of two legs being contained in a flux concentrator composed of C-laminations.

In FIG. 8, these counter electrical currents are reduced by providing the conductor legs 82*a,b,c,d* as fine, stranded, water-cooled wire 84 in casings 86, for example of electrically nonconductive material, such as nylon, rubber, etc. The cooling water runs within the casings, in the spaces between the wires.

Figure 9:
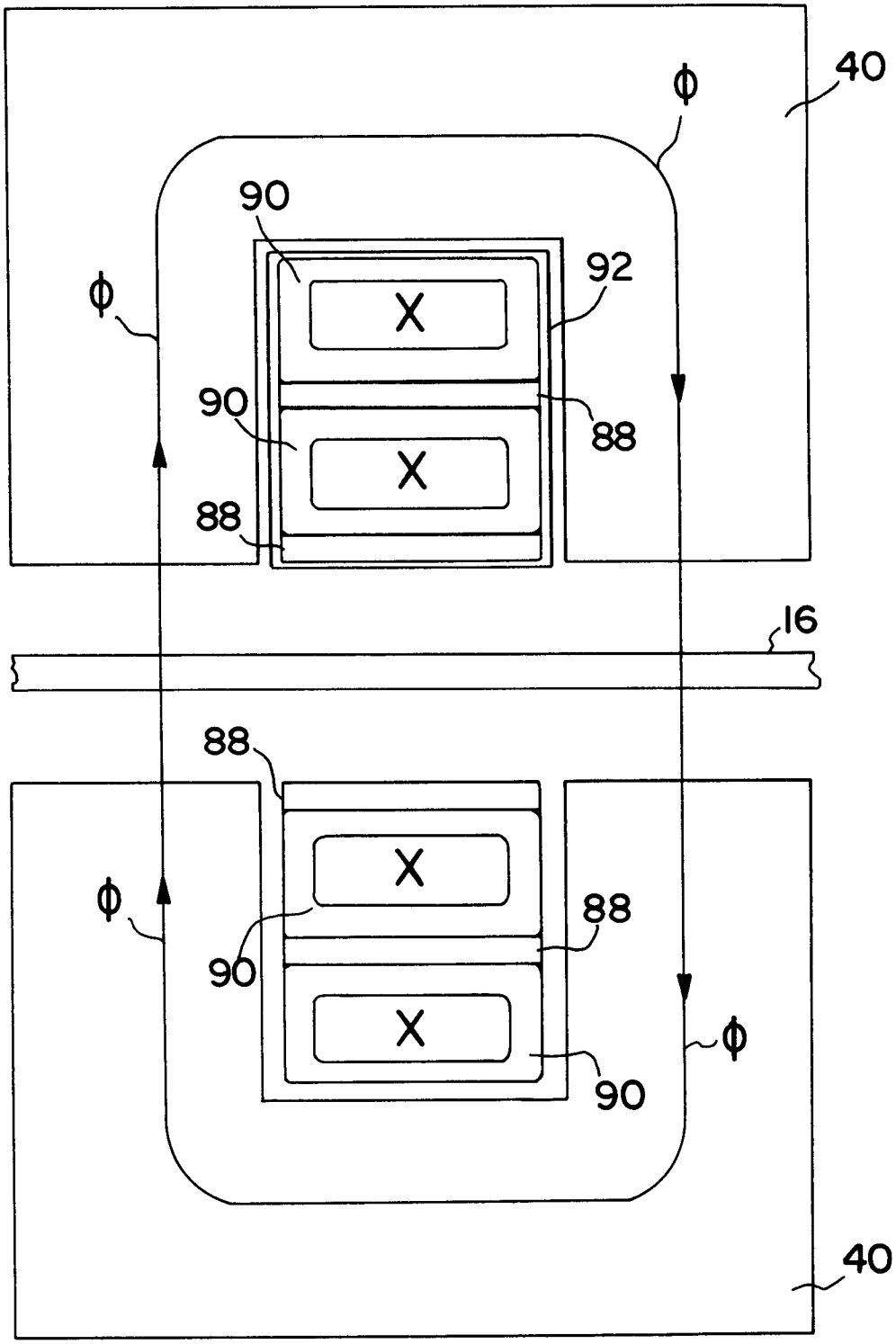
FIG. 9 is a view as in FIG. 8, of another embodiment of the invention.

FIG. 9 makes use of the principle that copper strap 88 has a thickness of 1 to 1.25 times greater than the depth of current penetration d (as defined in the BACKGROUND ART article), so that reverse induced current cannot flow in an inner layer due to current in an outer layer. Examples of suitable strap thicknesses are 0.10-inches for 1000 hz and 0.0625 for 3000 hz. The copper straps are attached, e.g. adhesively bonded, to electrically nonconductive, e.g. nylon, tubes 90 carrying cooling water, and the assemblies are wrapped together with electrical tap 92 and then varnished. These assemblies are then placed in magnetic flux concentrators 40 carrying magnetic flux $\phi$. The two assembled conductors above strip 16 correspond, for instance, to conductor legs 12*a,b* of FIG. 1B.

Figure 10:
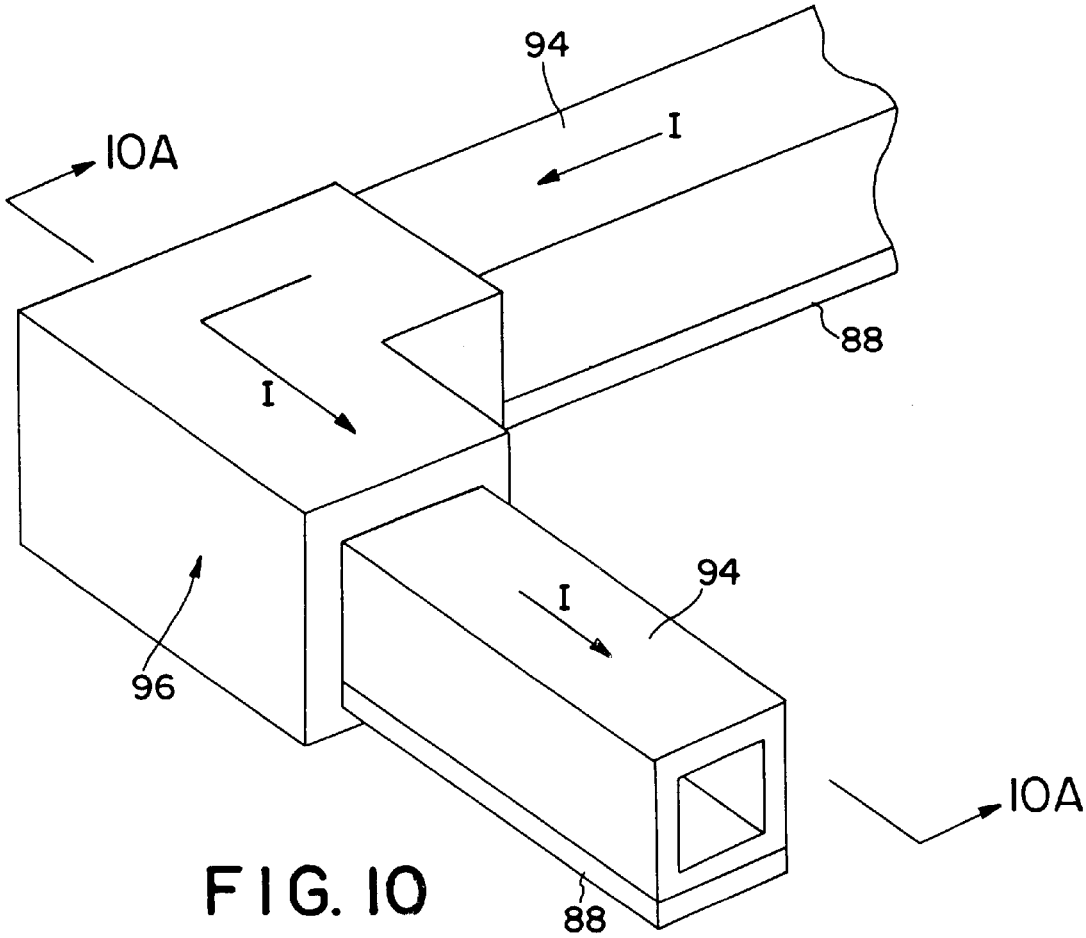
FIG. 10 is a perspective view of a portion of an inductor.
Figure 10A:
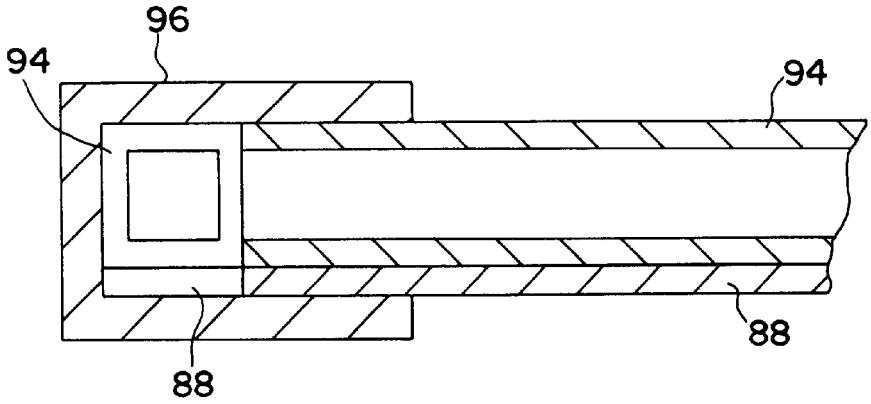
FIG. 10A is a cross sectional view taken on the cutting plane 10A—10A of FIG. 10.

The embodiment of FIGS. 10 and 10A is similar to that of FIG. 9, but is of all metal construction. Copper strap 88 is bonded, e.g. brazed, soldered, or vapor deposited or sputtered, to Series-300, austenitic, non-magnetic stainless steel tube 94 carrying cooling water. This embodiment facilitates the corners of the inductor coils by application of a copper elbow 96, which is brazed or soldered to the tube-strap combinations. The inductor current I in the conductor portion shown flows mainly in the copper strap, due to the fact that the electrical resistivity of the stainless steel is about 50 times higher than that of copper. When conductor legs of this embodiment are stacked, care must be taken to insulate the legs from one another, because of its all-metal construction.

FIGS. 11, 11A and 12, 12A illustrate other embodiments of, respectively, unilateral and bilateral, split-return inductors applying hollow, wedge-cross-sectioned conductors concentrating flux and current in narrow regions on strip 16. In this case, the apexes 50 are sharp, rather than truncated. While sharp apexes are preferred, because they give higher current density, truncated apexes may be needed, in order to adequately transfer heat from the apexes into the water cooled cores of the conductors.

Figure 11:
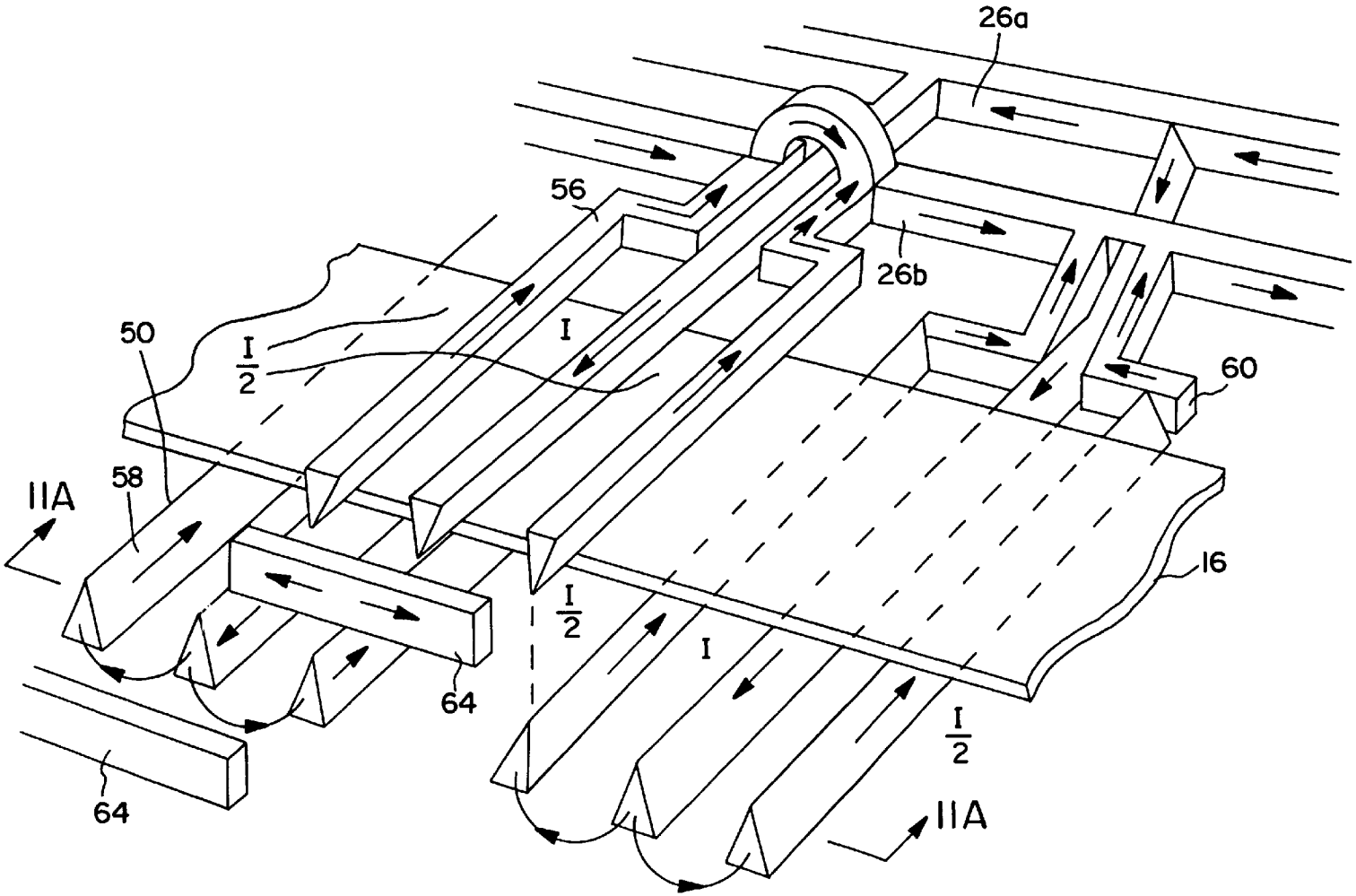
FIGS. 11 and 12 are perspective views of other embodiments of the invention.
Figure 11A:
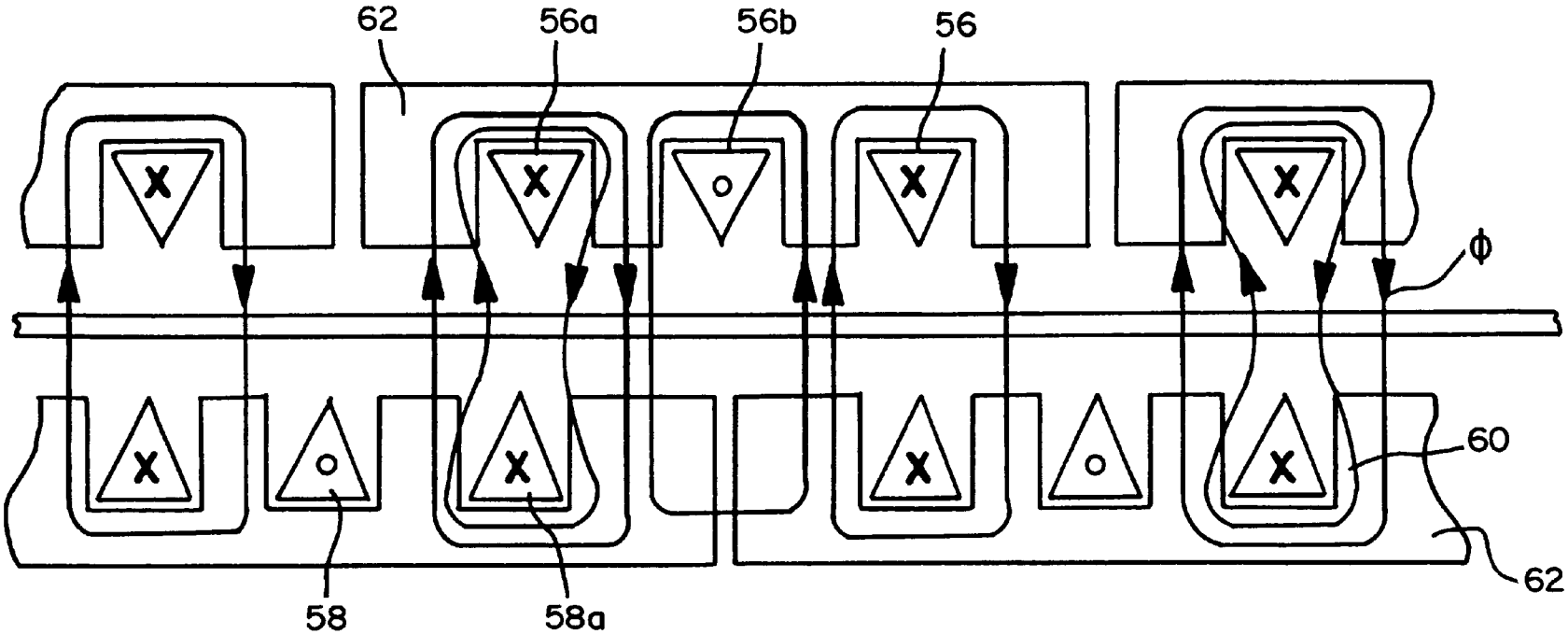
FIGS. 11A and 12A are schematic, end views taken, respectively, from the viewing planes 11A—11A of FIGS. 11 and 12A—12A of FIG. 12.

FIGS. 11, 11A show the unilateral case. The inductors, 56 above the strip and 58, 60 below the strip, are staggered relative to one another, so that the current directions on the return legs above and below the strip, for example legs 56*a* and 58*c*, are the same, in order that the inductive currents generated in the strip add, rather than cancel. Therefore, the strip section extending across the strip between legs 56*a* and 58*c* is affected by I/2 from above and I/2 from below, so that it is heated essentially the same as the strip section beneath a center leg, such as leg 56*b*.

In contrast, the strip edges are affected only by a single I/2. Thus, as indicated in FIG. 11, each inductor has an end cap 64 for shunting the current from the center legs into the return legs. Besides carrying only ½ the current of the center legs, the end caps are of rectangular cross section, rather than wedge-shaped, toward the goal of spreading, rather than concentrating, the current induced in the strip edges.

FIG. 11A shows that each inductor is encased in a flux concentrator 62.

Figure 12:
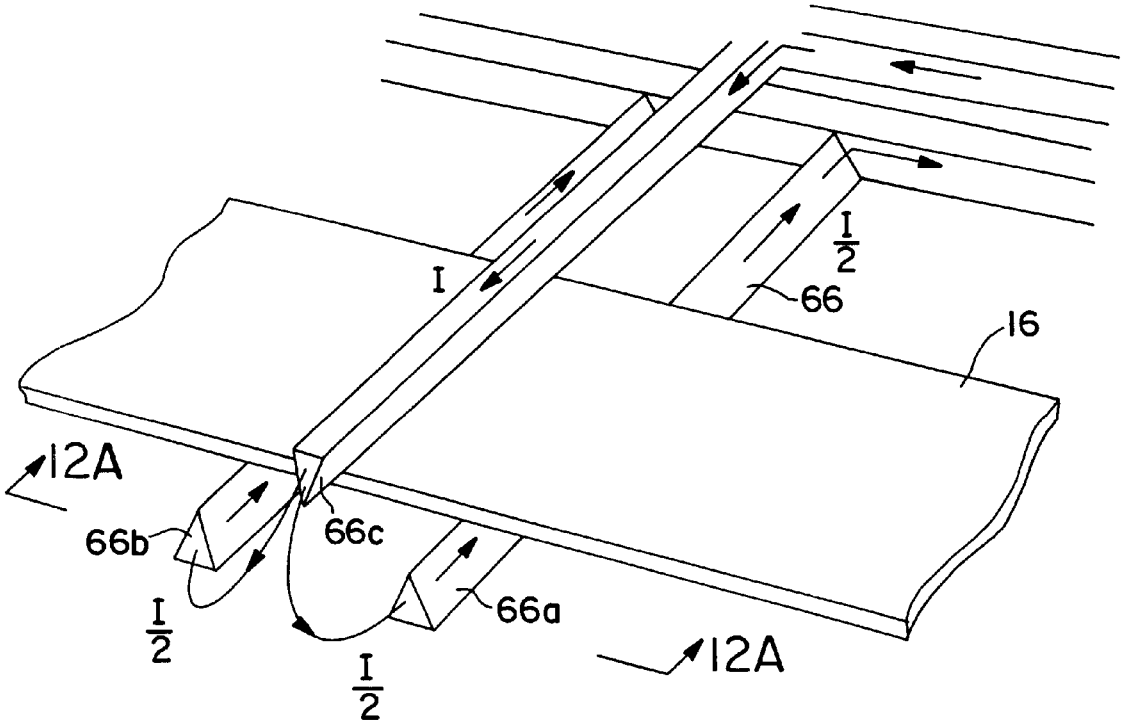
Figure 12A:
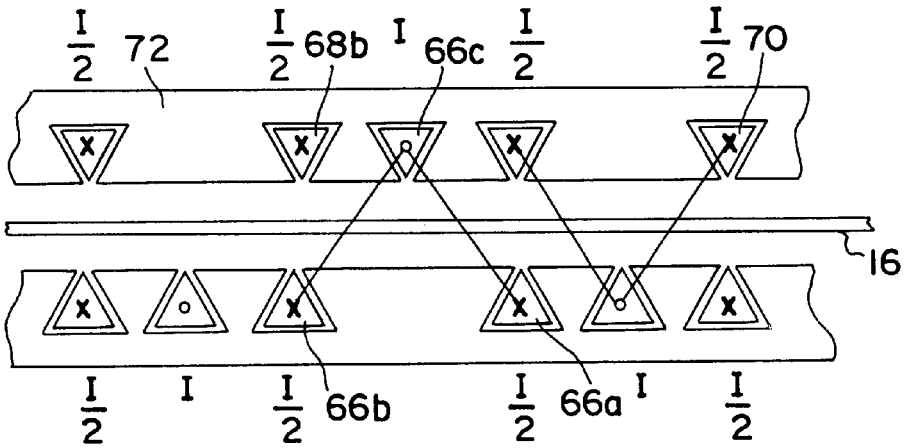

FIGS. 12,12A show the bilateral case. The inductors 66,68,70, encased in flux concentrators 72, are again staggered relative to one another, so that the current directions on the return legs, for example legs 66*b* and 68*b*, reinforce, rather than oppose, one another in their inductive effect on the strip.

Figure 13:
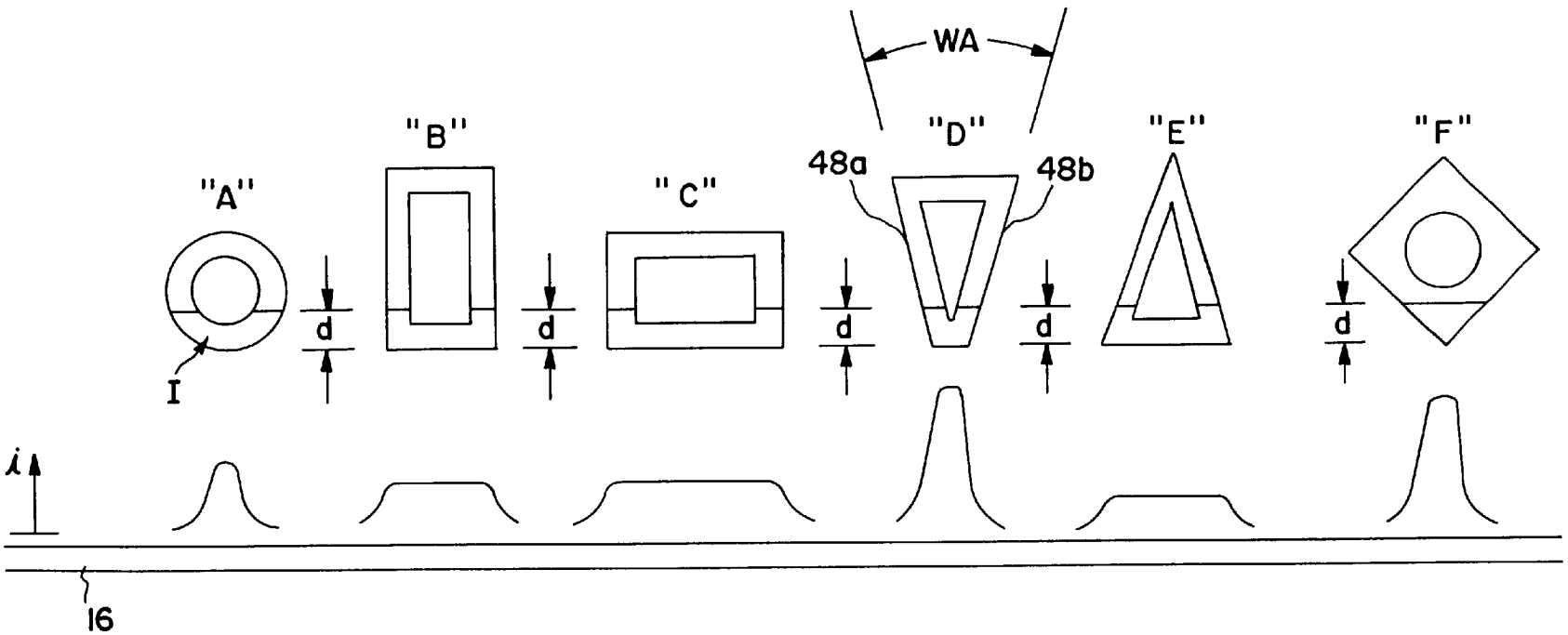
FIG. 13 is a schematic representation of the cross sections of 6 different conductor legs carrying inductor current I and the transverse induced current flow i which they cause in a metal strip.

FIG. 13 illustrates the effect of conductor cross section on induced current distribution in a load such as an electrically conducting strip 16. For all cases A through F, the electrical current is alternating in time, i.e. alternating, or ac current, of frequency F measured in hertz or cycles per second. For ac current, the current crowds near the surface of the conductor. This is known as "skin effect" and is measured by depth of current penetration d according to the equation in my paper referenced above in BACKGROUND ART. When the conductor is placed by a load, the same current I in each of cases A through F crowds toward the load, into the shaded portions at the bottoms of the conductors in FIG. 13, and this, in turn, leads to the different induced current distributions, as a function of conductor shape, drawn in the bottom of FIG. 13.

A preferred, concentrated distribution is obtained in the case of wedge-shaped cross section D, whose wedge angle WA is 40-degrees, for example (i.e., sides 48*a,b* are separated by 40 degrees). Sides 48*a,b* converge toward the load, strip 16. Wedge D has a truncated apex 50. Wedge D must be custom extruded. Hollow tubing F of square cross section is an available item of commerce. When tubing F is placed with its edge down, it supplies much of the current concentrating effect of wedge D. Tubing F has a wedge-shaped cross section with a wedge angle of 90-degrees.

Figure 14A:
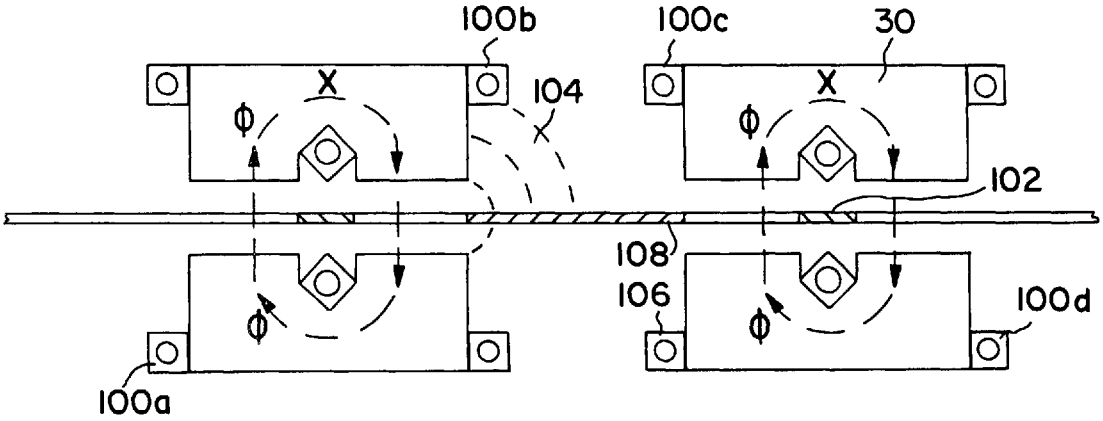
FIGS. 14A and 14B show an installation using case F of the conductor legs of FIG. 13, FIG. 14A being a cross section taken on the cutting plane 14A—14A of FIG. 14B, and FIG. 14B having flux guides removed to expose the inductors completely.
Figure 14B:
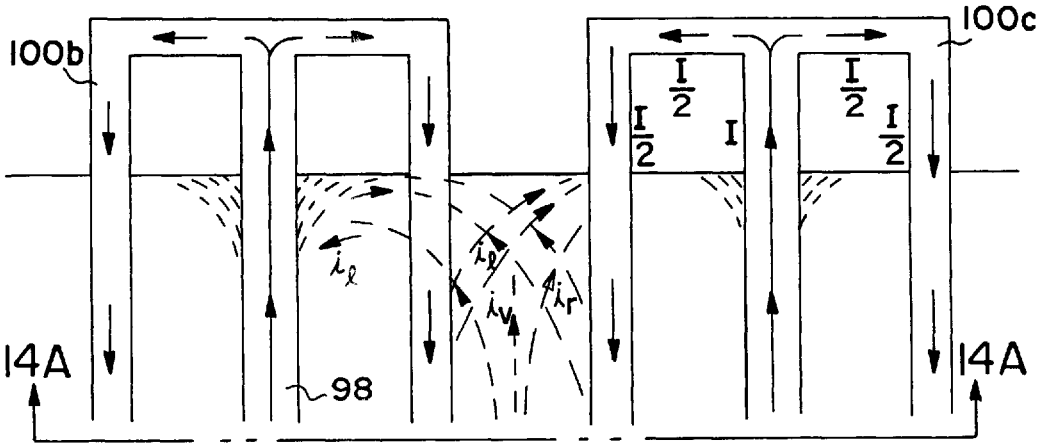

FIGS. 14A,B show an installation using tubing F of FIG. 13 as the center leg 98 of split-return inductors 100*a,b,c,d*. Zones 102 of strip 16 receive high induced current density, while the field in the region of field map 104 is spread out, due to the far location of the return legs 106 from the strip and the fact that the flat sides of the legs are turned toward the strip, leading to low density of return induced currents in the strip in zone 108. FIG. 14B shows how the induced current $i_l$ from the inductors 100*a,b* to the left add as vectors to the induced current $i_r$ to produce the vector sum current $i_v$.

FIGS. 15, 15A, 16, 16A illustrate another way of adjusting the balance of strip heating. This technique may be used independently or in conjunction with other features of the invention. This technique uses a U-shaped conductor 76, in contrast to the J-shape of my earlier U.S. Pat. No. 4,751,360.

Figure 15:
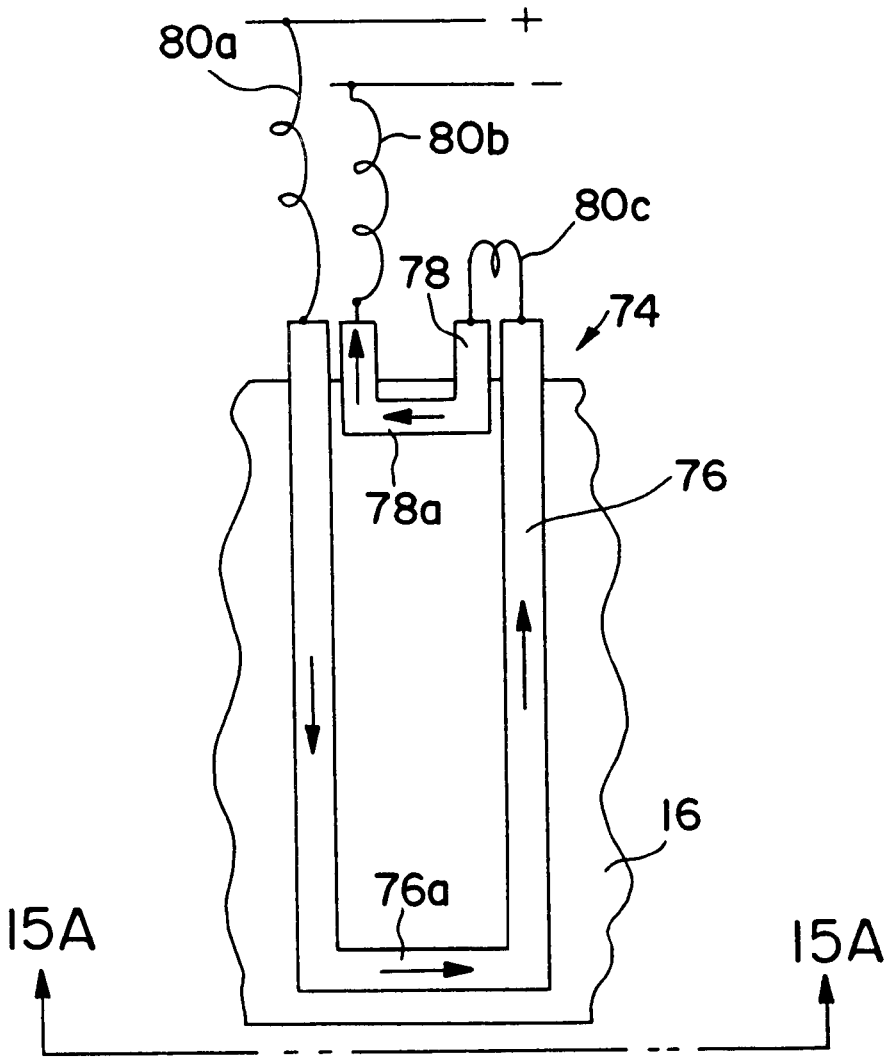
FIG. 15 is a schematic, top view of one inductor coil arranged above, and one below, a metallic strip.
Figure 15A:
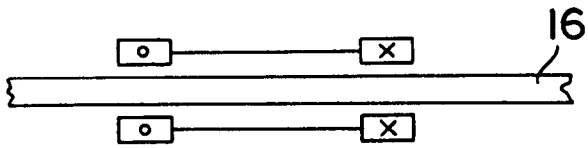
FIG. 15A is a schematic view of the coils and strip of FIG. 15 taken from the viewing plane 15A—15A of FIG. 15.

Thus, with reference to FIGS. 15, 15A an inductor 74 is shown, composed of a large U-shaped conductor section 76 and a small U-shaped conductor section 78. These sections are electrically interconnected with one another and with the buses by flexible water-cooled leads 80*a,b,c,* so that the U-sections can be adjusted crosswise to the strip 16 and relative to one another to place their conductor legs 76*a* and 78*a* at the bases of the U-sections in the length direction of strip 16 at adjustable distances from the strip edges. It is evident that the small section 78 can be minimized from a U-shape to a bar-shape composed of only a bar for the conductor leg 78*a*.

Figure 16:
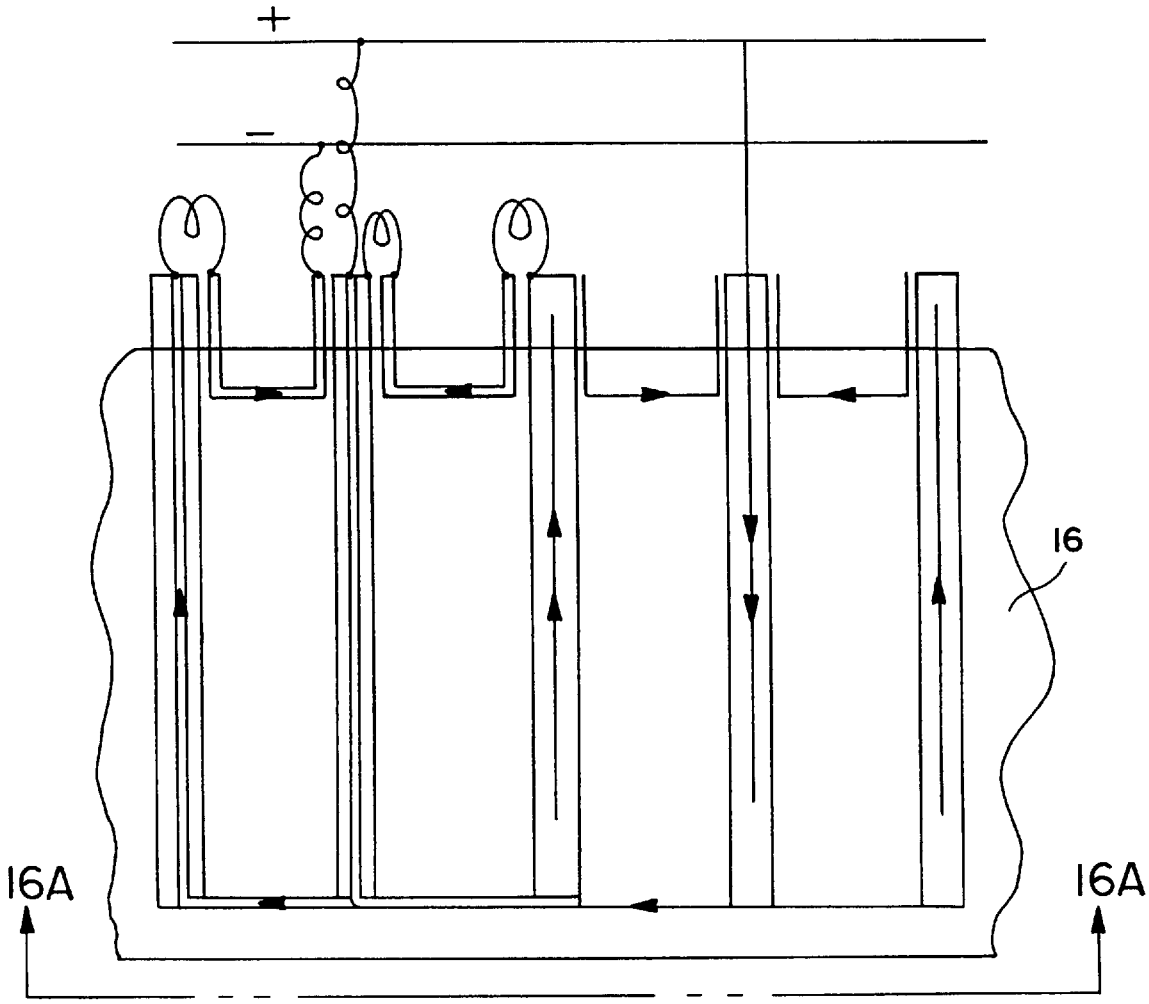
FIG. 16 is a schematic, top view of a number of coils of FIG. 15, with four coils arranged above, and four below, a metallic strip.
Figure 16A:
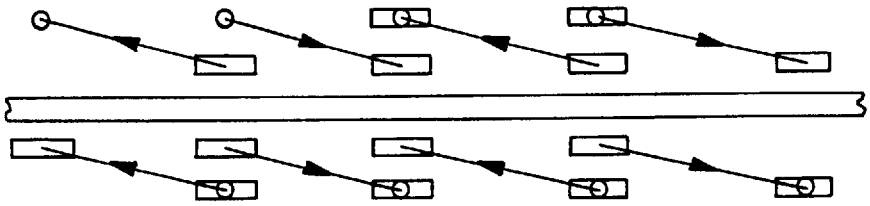
FIG. 16A is a schematic views of the coils and strip of FIG. 16 taken from the viewing plane 16A—16A of FIG. 16.

FIGS. 16,16A show that a number of inductors as in FIGS. 15,15A can be connected in series and have their legs across strip 16 stacked in the direction perpendicular to the plane of the strip, in order to combine the adjustability of the edge heating through a U-shaped conductor section with the increased current density heating across the width of the strip achieved by conductor leg stacking. FIGS. 16,16A show conductor legs outermost from the strip in circular cross section, in order to enhance visualization of the stacking.

There follows, now, the claims. It is to be understood that the above are merely preferred modes of carrying-out the invention and that various changes and alterations can be made without departing from the spirit and broader aspects of the invention as defined by the claims set forth below and by the range of equivalency allowed by law.

What is claimed is:

1. In a method for transverse flux induction heating of electrically conductive strip, the improvement comprising providing that induced current flowing across strip width is a multiple of that flowing along the strip edges, further comprising arranging inductor conductors across the strip width and stacking said conductors perpendicularly to the strip for increasing the induced current across the strip compared to the induced current along the strip edges.

2. A method as claimed in claim 1, further comprising providing an inductor having a U-section extending across the strip, with a base extending along an edge of the strip, the U-section being adjustable in position to place the base at varying distances from the edge.

3. A method as claimed in claim 1, wherein conductors across the width of the strip and conductors along the edges of the strip are connected in series to insure that the current which flows in the conductors is everywhere the same.

4. In a method for transverse flux induction heating of electrically conductive strip, the improvement comprising providing that induced current flowing across strip width is a multiple of that flowing along the strip edges, further comprising connecting inductor conductors that cross the strip width as split-return inductors for increasing the induced current across the strip compared to the induced current along the strip edges, with split-return conductors straddling the strip.

5. A transverse flux induction installation for heating metal strip having a first side and a second side, comprising two inductors arranged side-by-side on the first side of the strip, the inductors having neighboring conductors extending across strip width, the inductors being nested to stack said neighboring conductors perpendicularly to the strip and connected in series, so that electrical current in the two inductors is the same.

6. An installation as claimed in claim 5, further comprising two inductors arranged side-by-side on the second side of the strip, opposite those on the first side, having neighboring conductors extending across strip width, being nested to stack said neighboring conductors perpendicularly to the strip and connected in series with the inductors on the first side, so that electrical current in every inductor is the same.

7. In a method for transverse flux induction heating of electrically conductive strip, the improvement comprising overlapping at least two inductors at a strip to form a unit whose center legs extending across the strip are stacked in a direction perpendicular to a plane of the strip, the center legs connecting to legs diverging from one another to extend along an edge of the strip.

8. A method as claimed in claim 7, wherein the inductors are connected in series to insure that electrical current flowing in the legs is everywhere the same.

9. A method as claimed in claim 7, wherein the center legs comprise water-cooled wire.

10. A method as claimed in claim 7, wherein the center legs comprise metal strap assembled with water-cooling tubes.

11. A method as claimed in claim 10, wherein the tubes comprise an electrically non-conductive material.

12. A method as claimed in claim 10, wherein the metal strap comprises copper, the tubes comprise austenitic stainless steel, and the copper is bonded to the tubes.

13. In a method for transverse flux induction heating of electrically conductive strip, the improvement comprising arranging at least one split-return inductor at a strip in such a way that its center leg extends across the strip and its return legs diverge from one another to extend along an edge of the strip, the center leg being on a first side of the strip and the return legs being on a second side of the strip.

14. A method as claimed in claim 13, wherein there are at least two inductors, one with a center leg on a first side of the strip and one with a center leg on a second side of the strip, the inductors being staggered such that a strip section extending across the strip between two return legs is affected additively, so as to be heated essentially the same as a strip section facing a center leg, and a strip edge is affected only by a sin le return leg.

15. A method as claimed in claim 14, wherein legs extending across the strip have the shape of a wedge, sides of the wedge converging toward the strip to an apex extending across the strip.

16. In a method for transverse flux induction heating of electrically conductive strip, the improvement comprising arranging at least one split-return inductor at a strip in such a way that its center leg extends across the strip and its return legs diverge from one another to extend along an edge of the strip, wherein there are at least two inductors, one on a first side of the strip and one on a second side of the strip, the inductors being staggered such that a strip section extending across the strip between two return legs is affected additively, so as to be heated essentially the same as a strip section facing a center leg, and a strip edge is affected only by a single return leg.

17. A method as claimed in claim 16, wherein legs extending across the strip have the shape of a wedge, sides of the wedge converging toward the strip to an apex extending across the strip.

18. In a method for transverse flux induction heating of electrically conductive strip, the improvement comprising arranging at least one inductor at a strip in such a way that at least one leg of the inductor extends across the strip, the leg having the shape of a wedge, sides of the wedge converging toward the strip to an apex extending across the strip, the leg having a square cross section, thereby providing a wedge angle of 90-degrees.

19. In a method for transverse flux induction heating of electrically conductive strip, the improvement comprising arranging at least one inductor at a strip, the inductor having a U-section extending across the strip, with a base extending along an edge of the strip, the U-section being adjustable in position to place the base at varying distances from the edge and wherein the inductor further includes a leg which is adjustable in position along a second edge of the strip.

* * * * *